US005477316A

United States Patent [19]

Morganti et al.

[11] Patent Number: 5,477,316

[45] Date of Patent: Dec. 19, 1995

[54] ARTICULATABLE WICK ASSEMBLY

[75] Inventors: Terry N. Morganti, Brockport; Daniel R. Palmer, Rochester, both of N.Y.

[73] Assignee: Eastman Kodak Company, Rochester, N.Y.

[21] Appl. No.: 245,982

[22] Filed: May 18, 1994

[51] Int. Cl.[6] ..... G03G 15/20

[52] U.S. Cl. ..... 355/284; 118/60; 219/216

[58] Field of Search ..... 355/284, 289, 355/290, 282; 118/60, DIG. 1, 260, 268, 667; 219/216, 388

[56] References Cited

U.S. PATENT DOCUMENTS

| | | | |
|---|---|---|---|
| 3,941,085 | 3/1976 | Hattler et al. | 118/60 |
| 4,193,681 | 3/1980 | Tanigawa et al. | 118/667 X |
| 4,254,732 | 3/1981 | Moser | 118/60 |
| 4,429,990 | 2/1984 | Tamary . | |
| 4,743,943 | 5/1988 | Adams, Jr. et al. | 118/260 X |
| 4,751,548 | 6/1988 | Lawson | 118/60 X |
| 4,908,670 | 3/1990 | Ndebi | 355/284 |
| 4,942,433 | 7/1990 | Stuart | 355/284 |
| 4,945,285 | 7/1990 | Gehret | 313/278 |
| 5,043,768 | 8/1991 | Baruch | 355/284 |
| 5,045,889 | 9/1991 | Hoover | 355/284 |
| 5,132,739 | 7/1992 | Mauer et al. | 355/284 |
| 5,191,380 | 3/1993 | Hoover et al. | 355/284 |
| 5,202,734 | 4/1993 | Pawlik et al. | 355/284 |
| 5,221,947 | 6/1993 | Ndebi et al. | 355/285 |
| 5,235,394 | 8/1993 | Mills et al. | 355/284 |
| 5,263,004 | 11/1993 | Larson | 367/7 |
| 5,327,204 | 7/1994 | Sculley et al. | 355/284 |
| 5,374,983 | 12/1994 | Isogai | 355/284 |

FOREIGN PATENT DOCUMENTS

| | | | |
|---|---|---|---|
| 0103051 | 8/1979 | Japan | 355/284 |
| 4318585 | 11/1992 | Japan | 355/284 |
| 5165363 | 7/1993 | Japan | 355/284 |

*Primary Examiner*—A. T. Grimley
*Assistant Examiner*—Thu A. Dang
*Attorney, Agent, or Firm*—Leonard W. Treash, Jr.

[57] ABSTRACT

An articulatable wick assembly for applying offset-preventing liquid to a surface in a fuser includes support plates for each end. Each support plate has a bent cam tab and a spring engagement arm. Compression springs between each spring engagement arm and a base urge the wick into engagement with the surface to which liquid is to be applied. A cam engages the cam tab to rotate the wick away from the surface against the urging of the spring. Each support plate is mounted to a pivot bar for pivotal movement of the wick assembly.

4 Claims, 2 Drawing Sheets

ARTICULATABLE WICK ASSEMBLY

This invention relates to the fusing of toner images. More specifically, this invention relates to an articulatable wick assembly for the application of offset-preventing liquid to a surface in a fuser.

U.S. Pat. No. 4,429,990 to Tamary, issued Feb. 7, 1984, shows the application of offset-preventing liquid to a rotating roller in a fuser using a rotatable wick which is rolled by the roller. To control the amount of release liquid applied, the wick is periodically articulated out of engagement with the roller.

Various wicks and/or articulation structures are shown in the following patents: U.S. Pat. No. 4,908,670 to Ndebi, issued Mar. 13, 1990; U.S. Pat. No. 4,942,433 to Smart, issued Jul. 17, 1990; U.S. Pat. No. 5,043,768 to Bamch, issued Aug. 27, 1991; U.S. Pat. No. 5,045,889 to Hoover, issued Sep. 3, 1991; U.S. Pat. No. 5,221,947 to Ndebi et al, issued Jun. 22, 1993; U.S. Pat. No. 5,235,394 to Mills, issued Aug. 10, 1993; U.S. Pat. No. 5,263,004 to Mills, issued Nov. 30, 1993; U.S. Pat. No. 5,132,739 to Mauer et al, issued Jul. 21, 1992; and U.S. Pat. No. 5,191,380 to Hoover et al, issued Mar. 2, 1993.

U.S. Pat. Nos. 5,235,394 and 5,191,380 both show articulation mechanisms in which competing springs control the movement of the wick. In each instance the stronger spring or other force-applying mechanism for engagement, is applied at a single point to a rigid wick assembly.

In a structure presently in commercial use a single flat spring engages a wick housing at a relatively central point to push the wick into engagement with the roller. The wick is disengaged by one or more cams which overcome the force of the spring. This structure is quite simple and works reasonably well. In some instances one end of the wick engages the roller before the other. A strong spring is necessary to be sure of engaging both ends. Wear between the wick and the roller is partially dependent on the force urging them together. Of course, more heavy wear results at the end of the wick first engaging the roller.

SUMMARY OF THE INVENTION

It is an object of the invention to provide an articulatable wick assembly for applying offset-preventing liquid oil to a surface in a fuser which is both simple and inexpensive and provides relatively even and gentle force the length of the engagement between the wick and the surface.

These and other objects are accomplished by an articulatable wick assembly including a wick having opposite ends and an axis of rotation. Supporting means at each end of the wick support the wick for rotation about its axis of rotation. The supporting means includes a support plate rotatably coupled to a fixed base for rotation about a support plate pivot fixed with respect to the base to move the wick into and out of engagement with said surface. The support plate has a cam tab, a spring engagement arm and a joining section joining the cam tab and the spring engagement arm. A cam associated with each end of the wick engages the respective cam tab of the support plate at that end for moving the support plate about the support plate pivot. A spring is is positioned between the base and each spring engagement arm to urge the respective cam tab against the cam and the end of the wick against the surface to be oiled.

According to a preferred embodiment, each support plate includes both two cam tabs and two holes. Either of the holes can receive a pivot bar which defines the support plate pivot.

With this design the support plates can be identical, though used at opposite ends.

According to a further preferred embodiment, the springs are each compression springs with a relatively low spring rate.

With the preferred structure the wick is gimbaled by the two compression springs to provide an even force across the length of the wick in its engagement with the surface being oiled. Each compression spring has a relatively low spring rate which also reduces variation in these forces due to manufacturing tolerances, etc. Each support plate provides both the interface with its cam and with its spring. It also helps define the pivot for the wick assembly. It is an inexpensive part that facilitates easy assembly of the wick assembly. The use of relatively low rate springs applied separately at the ends of the wick decreases the amount of force needed to be exerted by the cam and thereby reduces the risk of damage between the cam and the cam tab.

DETAILED DESCRIPTION OF THE INVENTION

Figure 1:
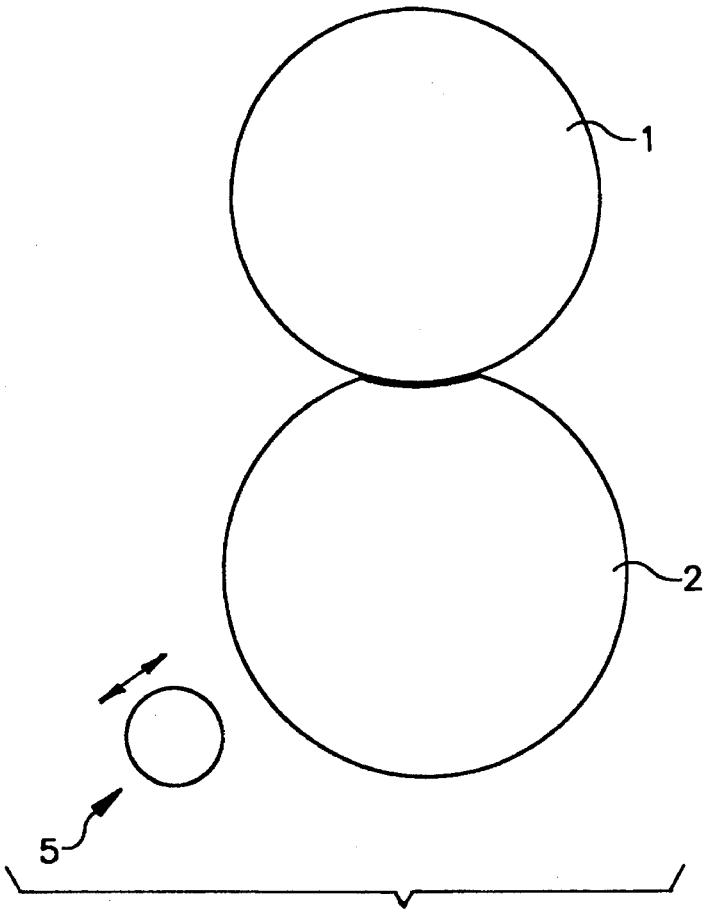
FIG. 1 is an end schematic of a fuser.

Referring to FIG. 1, a conventional fuser includes a pressure roller 1 and a fusing roller 2 which are engaged to provide a fusing nip. A sheet of suitable receiver material containing a toner image is fed into the nip with the toner image facing the fusing roller 2. Generally, the fusing roller is heated, and the combination of heat and pressure fixes the toner to the sheet. To prevent offset of toner onto the fusing roller 2, offset-preventing liquid, commonly called "oil," is applied to the surface of fusing roller 2 using an articulating wick 5. It is also known to apply oil to the pressure roller 1. Fusers are also known with endless belts instead of one or more of the rollers which also can be oiled. This invention is usable in all such applications.

Figure 3:
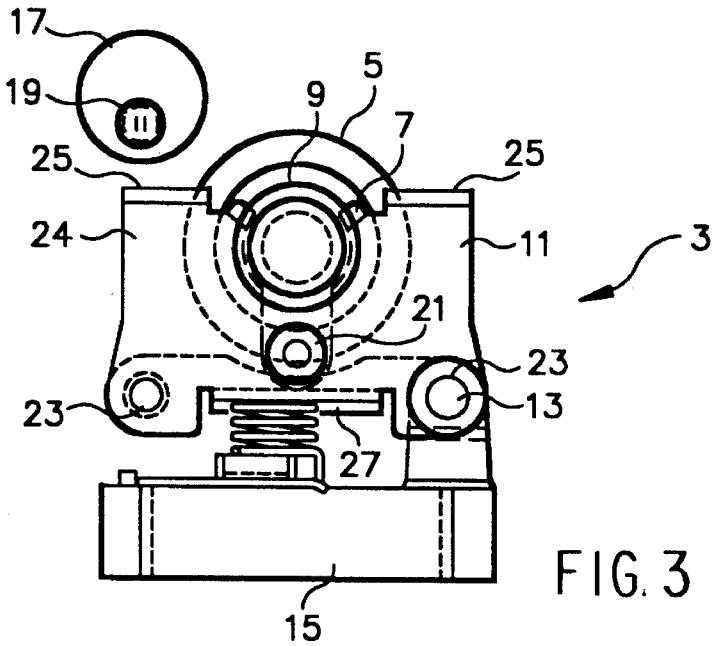
FIGS. 2 and 3 are side and end views, respectively, of a wicking assembly.
Figure 2:
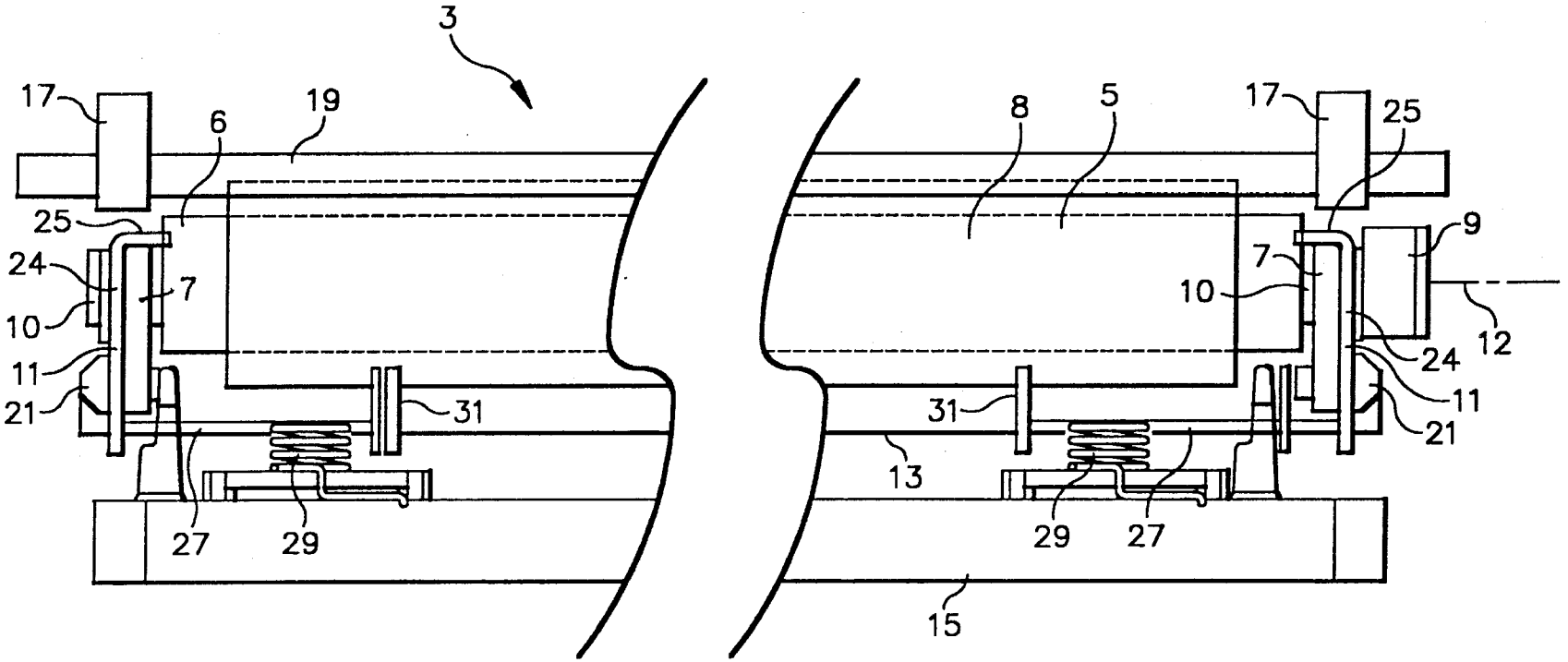

FIGS. 2 and 3 show the details of an articulating wick assembly 3 containing wick 5. Wick 5 is of conventional construction described more completely in many of the references cited above. In general, such wicks include a core 6 into which oil is fed through an oil supply fitting 9. The core 6 is made of a material which feeds the oil from the center of the wick 5 to an oil-spreading wrap 8 on its outside. Wick 5 has opposite ends and a shaft 10 which is rotatable about an axis of rotation 12. At each end a yoke 7 has a bearing surface which receives shaft 10 for rotation of wick 5 about the axis of rotation 12. As the wick is rolled by the surface to be oiled, it spreads an even coating of oil on it. The rolling contact causes relatively little wear to either the wick or the roller.

Because excess or insufficient oiling creates substantial image defects, the wick is articulated to control oiling. At each end of wick 5, support plate 11 in the shape of a sheet metal tub includes a joining section 24 which is fastened to yoke 7 by a bolt or other fastener 21. The yoke 7 and support plate 11 are detented together to prevent movement relative to each other about fastener 21. A pair of cam tabs 25 and a spring engagement arm 27 are bent from opposite ends of joining section 24 and are generally parallel with each other. One of cam tabs 25 is engageable by a cam 17 on a cam shaft 19 for movement away from the surface to be oiled. A compression spring 29 is positioned between a base or other support housing 15 and the spring engagement arm 27. Cam 17 moves support plate 11 against compression spring 29 in moving wick 5 away from the surface to be oiled. When cam 17 is in its retracted position, shown in FIGS. 2 and 3, springs 29 at each end of wick 5 provide the loading force between the wick and the surface to be oiled.

A pivot bar 13 is fixed with respect to base 15 and supports the wick assembly 3. Support plate 11 is mounted to pivot bar 13 through one of pivot holes 23. Spring engagement arm 27 is slidably attached to bar 13 with arm fasteners 31 which permit rotation of support plate 11 on pivot bar 13.

Note that support plate 11, as seen in FIG. 3, has two pivot holes 23 and two cam tabs 25. As seen in FIG. 3, the upper left cam tab 25 and the lower right pivot hole 23 are used for the support plate that is positioned at one end of wick 5 while the right cam tab 25 and the left pivot hole 23 is used for the support plate that is used at the other end of wick 5. Thus, the support plates are identical.

The two compression springs have relatively low spring rates, for example, about 18 pounds per inch. They replace a flat spring that required a spring rate of 50 pounds per inch to correct any tendency of one edge of the wick to contact the surface to be oiled first. The compression springs are less expensive and less susceptible to problems due to manufacturing tolerances. The lower spring force also improves the durability of the cam-cam tab interface.

Yoke 7 is preferably made out of stainless steel with a relatively low coefficient of friction which improves both wear and the oiling pattern. Support plate 11, although it could be made out of plastic, is preferably made out of a single piece of bent sheet metal. With the softness of springs 29, it is not subject to damage.

The invention has been described in detail with particular reference to a preferred embodiment thereof, but it will be understood that variations and modifications can be effected within the spirit and scope of the invention as described hereinabove and as defined in the appended claims.

We claim:

1. An articulatable wick assembly for applying offset-preventing liquid to a surface in a fuser, the articulatable wick assembly comprising:

a base, a wick having opposite ends and an axis of rotation, support means at each end for supporting the wick for rotation about the axis of rotation, each support means including a support plate rotatably coupled to the base for rotation of the assembly about a support plate pivot fixed with respect to the base to move the wick into and out of engagement with the surface, said support plate having a cam tab, a spring engagement arm and a joining section joining the cam tab and the spring engagement arm, said support plate having opposite ends and the cam tab and spring engagement arm extending from said opposite ends of said support plate essentially parallel to each other, a cam associated with each of said opposite ends for engaging the cam tab of the support plate at each end for moving the support plate about the support plate pivot and the wick away from the surface, and a spring positioned between the base and each spring engagement arm to urge the cam tab against its respective cam and the wick into engagement with the surface.

2. The wick assembly according to claim 1 wherein each support plate is a single piece of sheet metal and each cam tab and spring engagement arm are bent portions of the single piece of sheet metal.

3. An articulatable wick assembly for applying offset-preventing liquid to a surface in a fuser, the articulatable wick assembly comprising:

a base, a wick having opposite ends and an axis of rotation, support means at each end for supporting the wick for rotation about the axis of rotation, each support means including a support plate rotatably coupled to the base for rotation of the assembly about a support plate pivot fixed with respect to the base to move the wick into and out of engagement with the surface, said support plate having a cam tab, a spring engagement arm and a joining section joining the cam tab and the spring engagement arm, a cam associated with each of said opposite ends for engaging the cam tab of said support plate at that end for moving said support plate about said support plate pivot and the wick away from the surface, and a compression spring positioned between the base and each spring engagement arm to urge the cam tab against its respective cam and the wick into engagement with the surface as each spring urges its wick end toward its cam somewhat independently of the other spring to gimbal the wick with respect to the surface.

4. An articulatable wick assembly for applying offset-preventing liquid to a surface in a fuser, the articulatable wick assembly comprising:

a base, a wick having opposite ends and an axis of rotation, support means at each end for supporting the wick for rotation about the axis of rotation, each support means including a support plate rotatably coupled to the base for rotation of the assembly about a support plate pivot defined by a pivot bar which is fixed with respect to the base and received in a pivot hole in said support plate, to move the wick into and out of engagement with the surface, said support plate having a cam tab, a spring engagement arm, a joining section joining the cam tab and the spring engagement arm and means for fixing the spring engagement arm to the pivot bar, a cam associated with each of said opposite ends for engaging the cam tab of the support plate at that end for moving the support plate about the support plate pivot and the wick away from the surface, and a spring positioned between the base and each spring engagement arm to urge the cam tab against its respective cam and the wick into engagement with the surface.

* * * * *